US009199161B2

(12) United States Patent
Sawaya

(10) Patent No.: US 9,199,161 B2
(45) Date of Patent: Dec. 1, 2015

(54) TICKET SCRAPING DEVICE

(71) Applicant: Bernard M. Sawaya, Los Angeles, CA (US)

(72) Inventor: Bernard M. Sawaya, Los Angeles, CA (US)

( * ) Notice: Subject to any disclaimer, the term of this patent is extended or adjusted under 35 U.S.C. 154(b) by 0 days.

(21) Appl. No.: 14/243,764

(22) Filed: Apr. 2, 2014

(65) Prior Publication Data

US 2014/0304930 A1 Oct. 16, 2014

Related U.S. Application Data

(60) Provisional application No. 61/807,693, filed on Apr. 2, 2013.

(51) Int. Cl.
*A63F 3/06* (2006.01)
*A63F 9/24* (2006.01)

(52) U.S. Cl.
CPC ..... *A63F 3/068* (2013.01); *A63F 2009/2482* (2013.01)

(58) Field of Classification Search
CPC ..... A63F 3/068; A63F 3/0645; A63F 2009/2482; B25F 1/00; B24B 23/028; B24B 19/223
See application file for complete search history.

(56) References Cited

U.S. PATENT DOCUMENTS

| | | | | |
|---|---|---|---|---|
| 8,307,912 | B2 * | 11/2012 | Fisher | 173/205 |
| 2005/0265771 | A1 * | 12/2005 | Lord et al. | 401/198 |
| 2007/0037499 | A1 * | 2/2007 | Burbridge | 451/359 |
| 2007/0111831 | A1 * | 5/2007 | Sohm | 473/583 |

* cited by examiner

*Primary Examiner* — Shay Karls
(74) *Attorney, Agent, or Firm* — Adli Law Group P.C.

(57) ABSTRACT

A device for removing a covering film layer off of a ticket comprises a cylindrical housing which includes a battery compartment, a motor powered by the batteries within the battery compartment, a crankshaft connected to the motor and a scrapper element in contact with the crankshaft which moves in response to the motion generated by the motor. The scrapper element includes a tip that, when in contact with the film later on the ticket, removes the film from the ticket. Preferably, the scrapper element motion is from side to side. Preferably, the tip is a blade cut at a 47 degree angle with the scrapper element.

6 Claims, 13 Drawing Sheets

TICKET SCRAPING DEVICE

CROSS-REFERENCE TO RELATED PATENT APPLICATIONS

Embodiments of the present invention relate to U.S. Provisional Application Ser. No. 61/807,693, filed Apr. 2, 2013, entitled "MOTORIZED DEVICE", the contents of which are incorporated by reference herein and which is a basis for a claim of priority.

BACKGROUND OF THE INVENTION

Scratching lottery tickets can be burdensome. A user has to use his or her nails. Even if a user were to use an object like a coin, the user's hands can get strained. Additionally, many people may feel that the use of the hands for scratching a lottery ticket is not a socially acceptable task to be performed in public view.

There is a need in the art for a lottery ticket scratcher that solves these problems.

SUMMARY OF THE INVENTION

Provided is a motorized lottery scratcher that removes a layer of material meant to hide information from a lottery ticket. The motorized device has a motor and a power source, such as a battery. The motion of motor is preferably translated to an oscillation motion where a sharp object, preferably a razor, that is functionally connected to the motor, moves back and forth to scratch a lottery ticket or other such similar item where the object is to remove a layer of film from the ticket.

BRIEF DESCRIPTION OF THE DRAWINGS

FIG. 5A is a perpendicular view of tip, FIG. 5B is a top view or tip, FIG. 5C is a plain side view, FIG. 5D is a bottom view or tip, FIG. 5E is a perpendicular view of underside or tip, FIG. SF is a perspective view or top portion or tip., FIG. 5G is a perspective view or the bottom portion or tip.

FIG. 6A is a perspective view of cap, FIG. 6B is a bottom view of cap, FIG. 6C is a left side view of cap, FIG. 6Dis a right side view of cap.

FIG. 7B is a cut away blown up view of an exemplary embodiment of the present invention.

FIG. 8A shows a front perspective view, FIG. 8B shows back end view, FIG. 8C shows side view, FIG. 8D shows front view, FIG. 8E shows back perspective view, FIG. 8F shows back view.

FIG. 9A shows a perspective back view, FIG. 9B shows back view, FIG. 9C shows side view, FIG. 9D shows top view.

FIG. 10A is a perspective view, FIG. 10B is a cutaway view of cap bottom, FIG. 10C is another perspective undercap view, IFG. 10D is a side view, FIGS. 10E and 10F are side cutaway views.

FIG. 11A shows side view without cap, FIG. 11B shows side view of portion of main body and cap. FIG. 11C and 11D shows cap and body.

FIG. 13A is a perspective view, FIG. 13B is an end view and FIG. 13C is a side view.

DETAILED DESCRIPTION OF THE PREFERRED EMBODIMENT(S)

Figures 1, 1A, 1B, 1C, 1D, 1E:
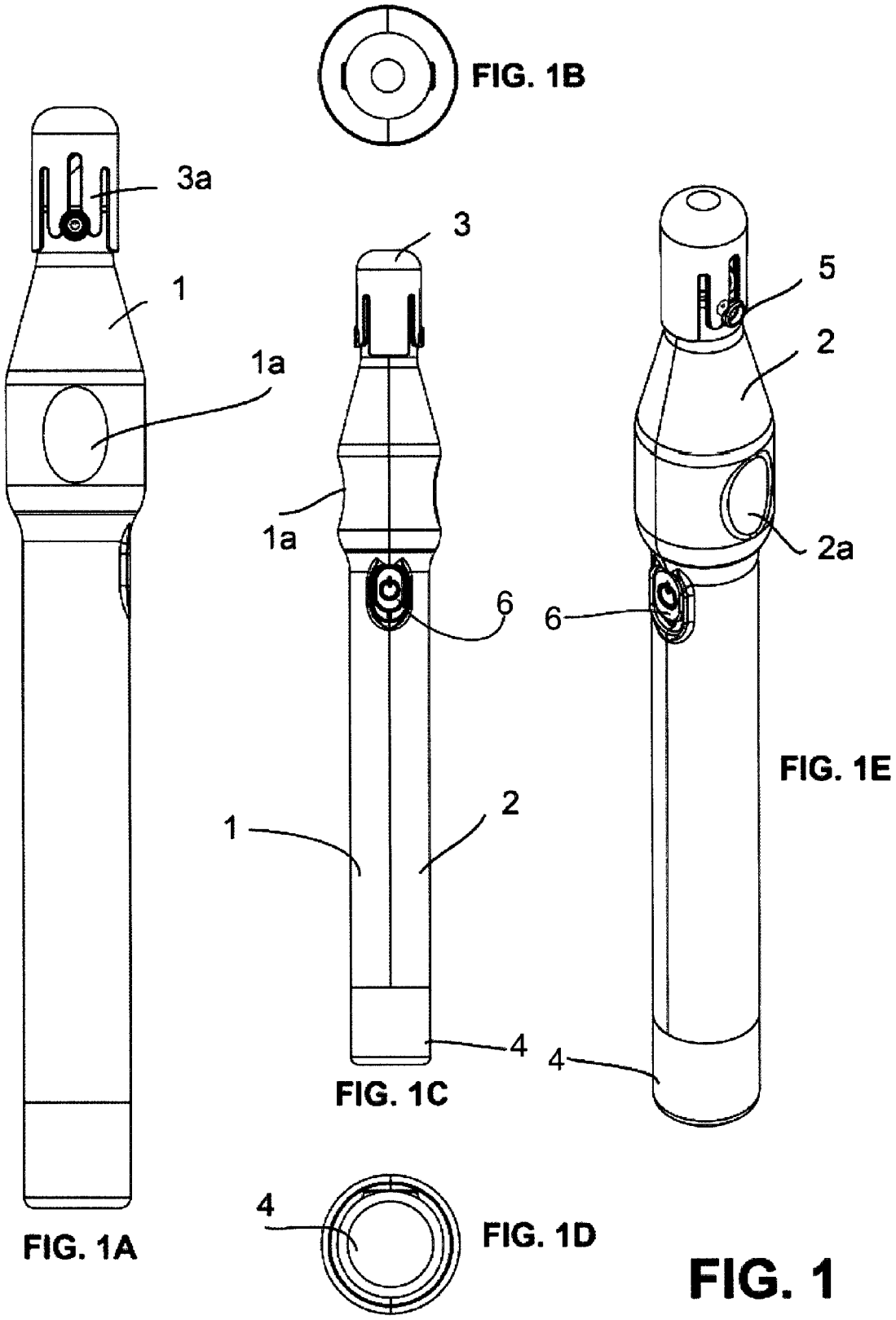
FIG. 1 consists of FIGS. 1A-1E which are each different views of illustrative diagrams showing the outer portions of an exemplary embodiment of the present invention.
FIG. 1A is a left view.
FIG. 1B is a top view.
FIG. 1C is a right side view.
FIG. 1D is a bottom view, FIG. lE is a perspective side view.

A device for removing a covering film layer off of a ticket comprises a cylindrical housing which includes a battery compartment, a motor powered by the batteries within the battery compartment, a crankshaft connected to the motor and a scrapper element in contact with the crankshaft which moves in response to the motion generated by the motor. The scrapper element includes a tip that, when in contact with the film later on the ticket, removes the film from the ticket. Preferably, the scrapper element motion is from side to side. Preferably, the tip is a blade cut at a 47 degree angle with respect to the scrapper element.

Details of the present invention will now be discussed by reference to the drawings.

FIG. 1A-1E is an illustrative diagram showing an illustration of the outer appearance of the inventive device according to an exemplary embodiment of the present invention. Housing 1, which is preferably partly cylindrical, provides a covering for the inventive device and is shown from a left view FIG. 1A and a right view FIG. 1C. User will preferably hold the device at locations identified by reference numerals 1*a* and 2*a*. Protective cap 3 provides protection for the blade and the otherwise exposed portion of the blade element. Snap keeper arm portion 3*a*, tail cap 4 and oscillator mounting view are also identified in FIG. 1A-1E.

Figure 2:
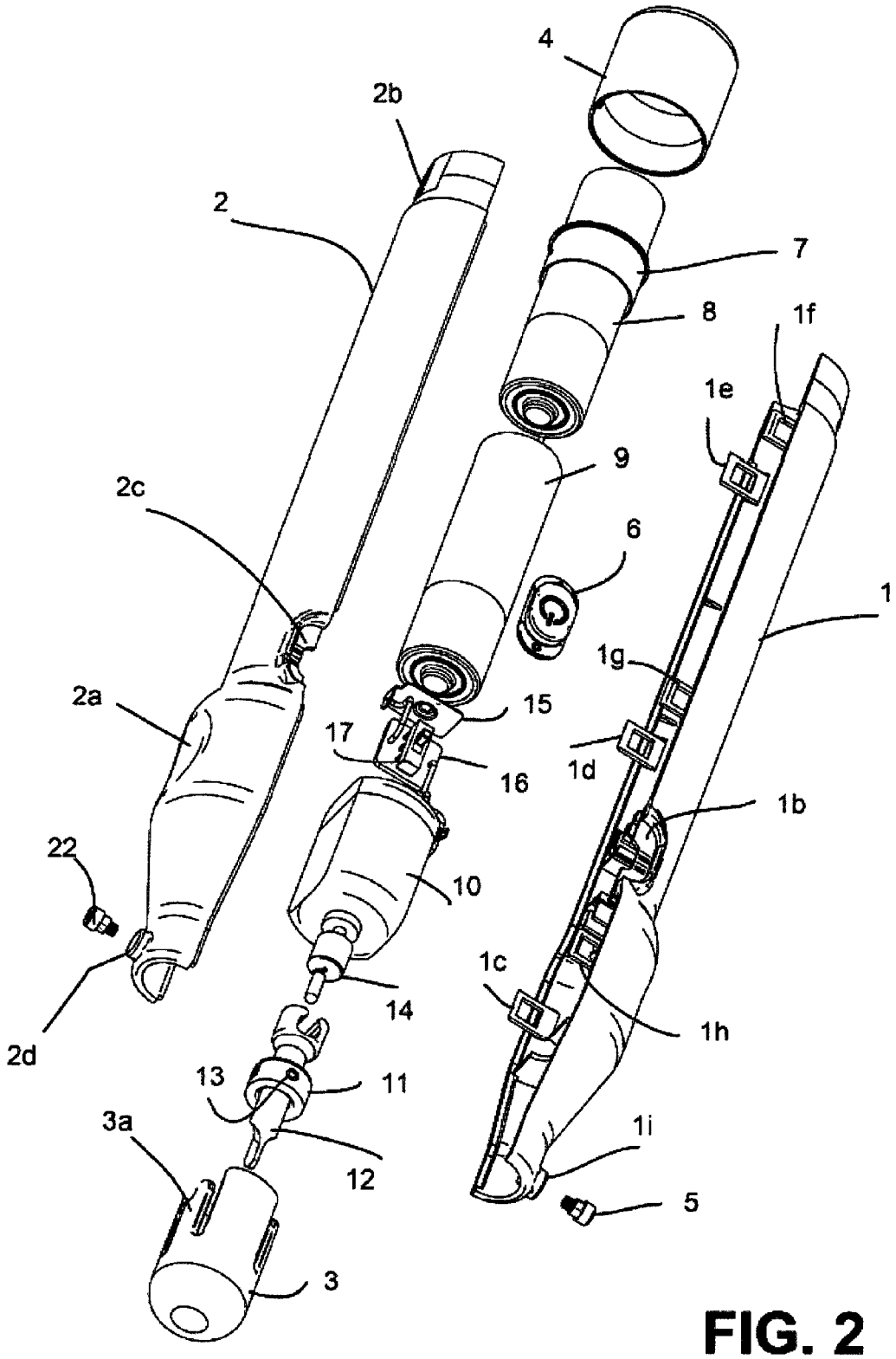
FIG. 2 is an illustrative diagram showing an exploded view of the various parts of the inventive device according to an exemplary embodiment of the present invention.

FIG. 2 is an illustrative diagram showing an exploded view of the various parts and components of the inventive device according to an exemplary embodiment of the present invention. The left and right side of the housing of the inventive device are identified by reference numerals 1 and 2. Snap keeper elements are identified by reference numerals 1*c* to 1*h*. Oscillator mounting holes and screws are identified by reference numerals 1*i* and 5 (left side) and 2*d* and 22 (right side) respectively. Oscillator mounting screw helps keep oscillator intact. Batteries 8 and 9 power motor 10. Preferably, the batteries are AA size and the motor is 1.5V-3.0 DC. Scrapper mounting ring 11 helps keep the scrapper element 11 intact. Crankshaft 14 converts the motion by motor 14 to an oscillating motion that performs the scraping function of the inventive device by removing a positive terminal clip 15, printed circuit board 16 and slide switch 17 are additionally identified.

Figures 3, 3A, 3B:
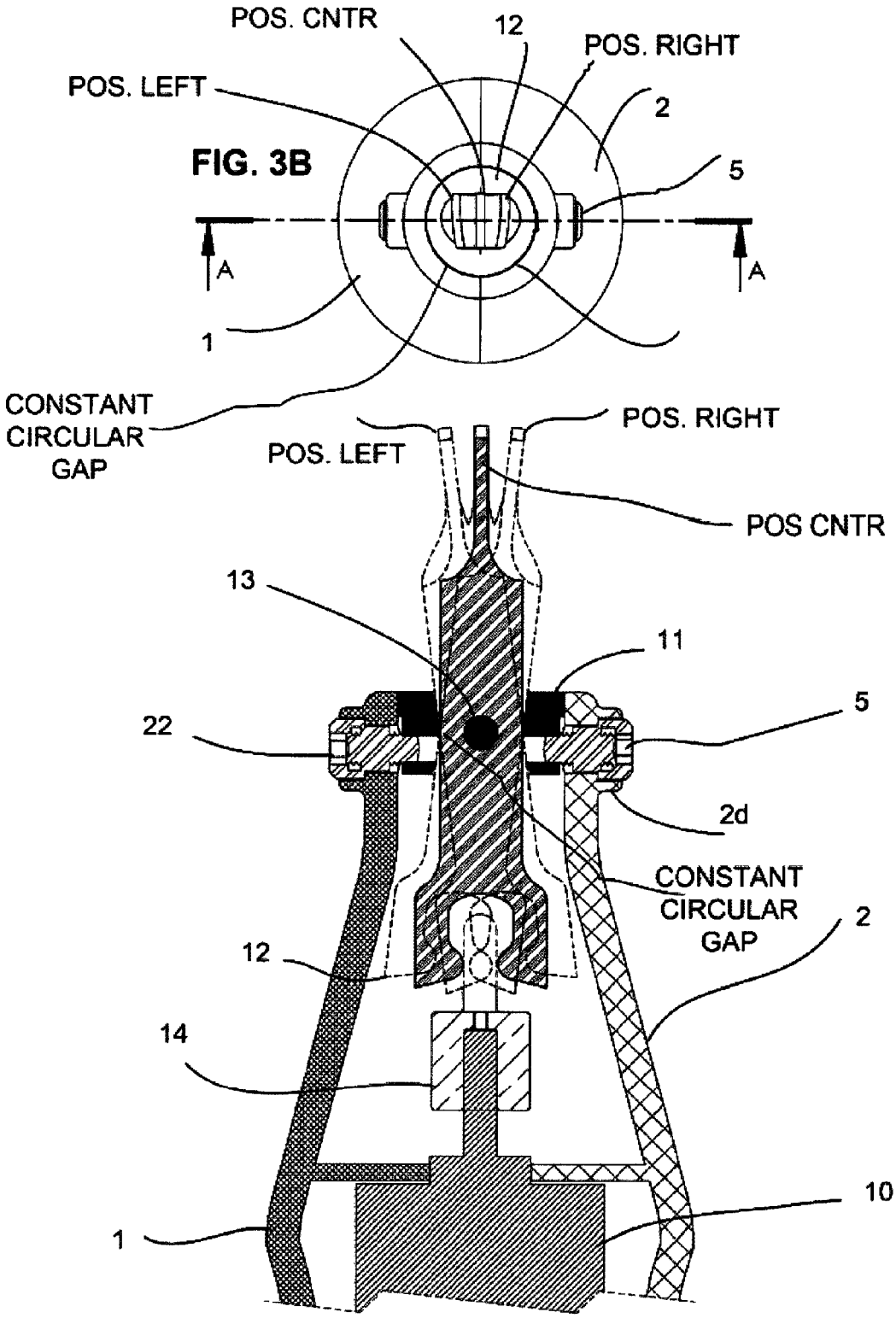
FIG. 3 consists of FIGS. 3A-3B which are illustrative diagrams.
FIG. 3B is showing a top view.
FIG. 3A is a side cross section of the inventive device according to an exemplary embodiment of the present invention.

FIG. 3A shows a top view cross section of unique design of the oscillating mechanism according to an embodiment of the present invention. Mounting ring 11 has a minimum opening at the pivoting contour to minimize scratched particles entering inside of the unit. Advantageously, this mechanism is removable for maintenance and or replacement with other specially formed edges for variety of applications. Scrapper element 2 is preferably made of wear resistance material such as polyetherimide (Ultem brand).

FIG. 3B depicts a front view of the oscillating pattern of the inventive device. All item numbers here are previously shown on FIG. 2.

Figure 4:
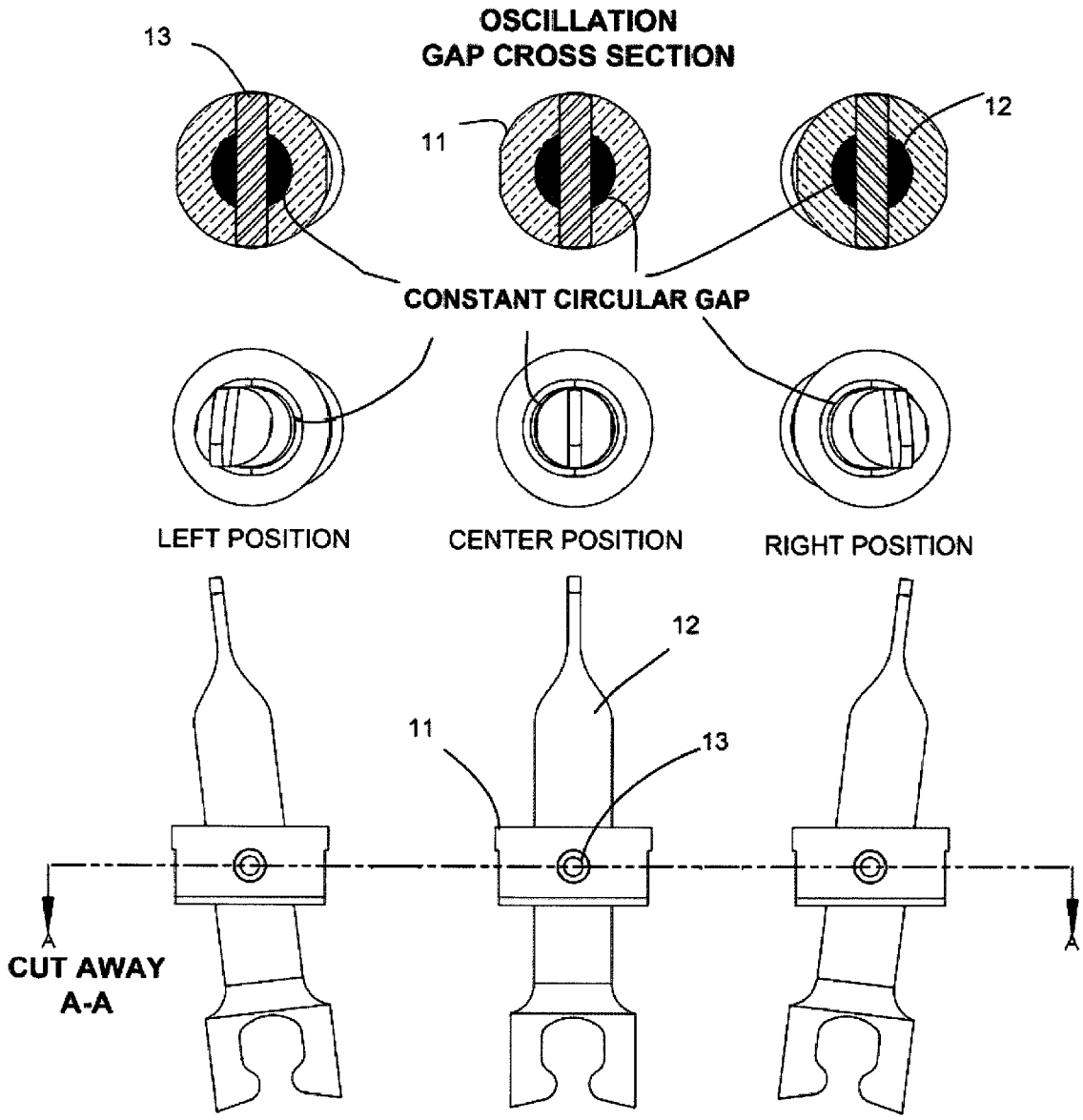
FIG. 4 is an illustrative diagram showing the front cross section of the inventive device according to an exemplary embodiment of the present invention.
Figure 5:
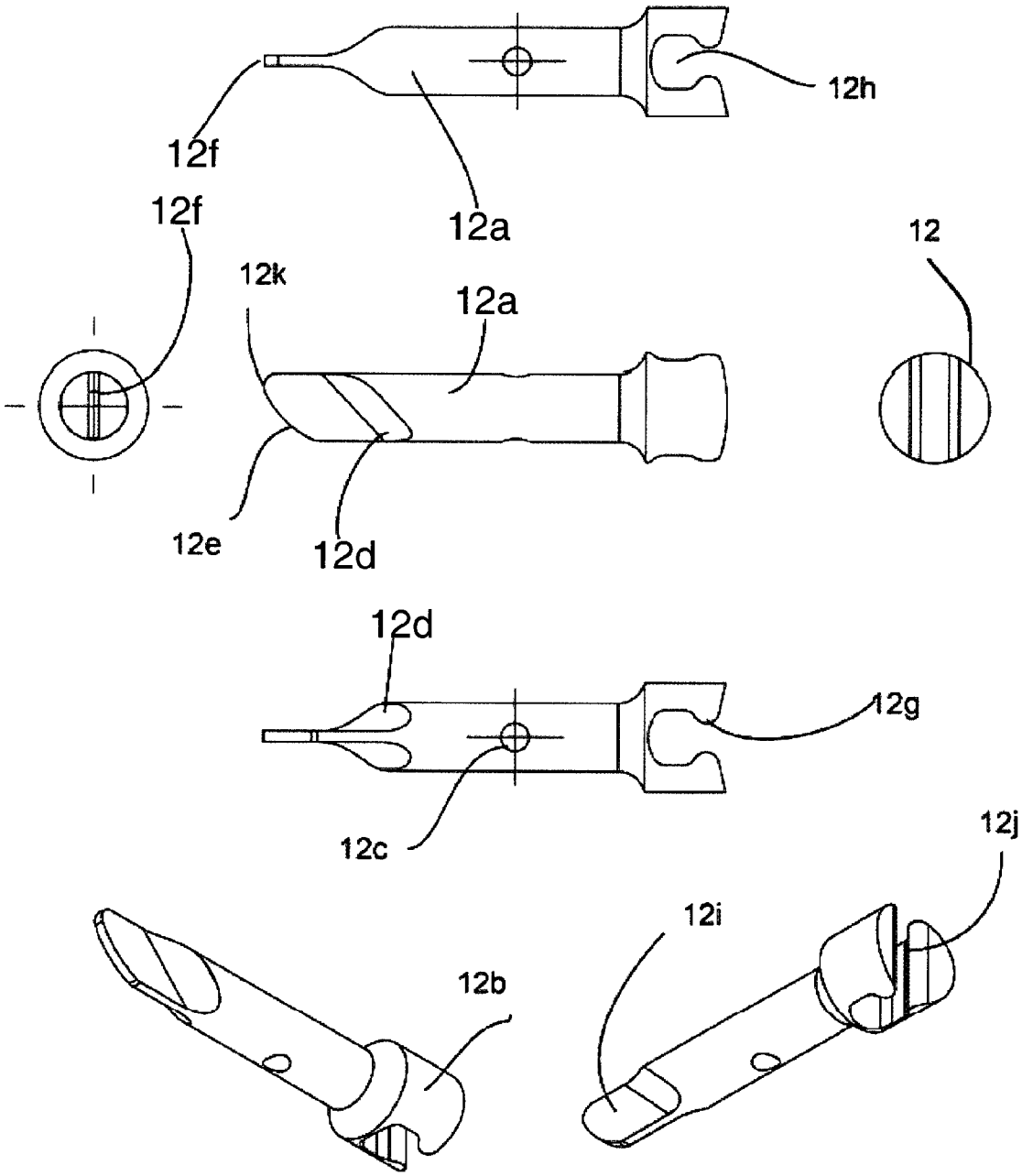
FIG. 5 consists of FIGS. 5A-5G which are illustrative diagrams showing various positions of the oscillating tip of the inventive device according to an exemplary embodiment of the present invention.
Figure 6:
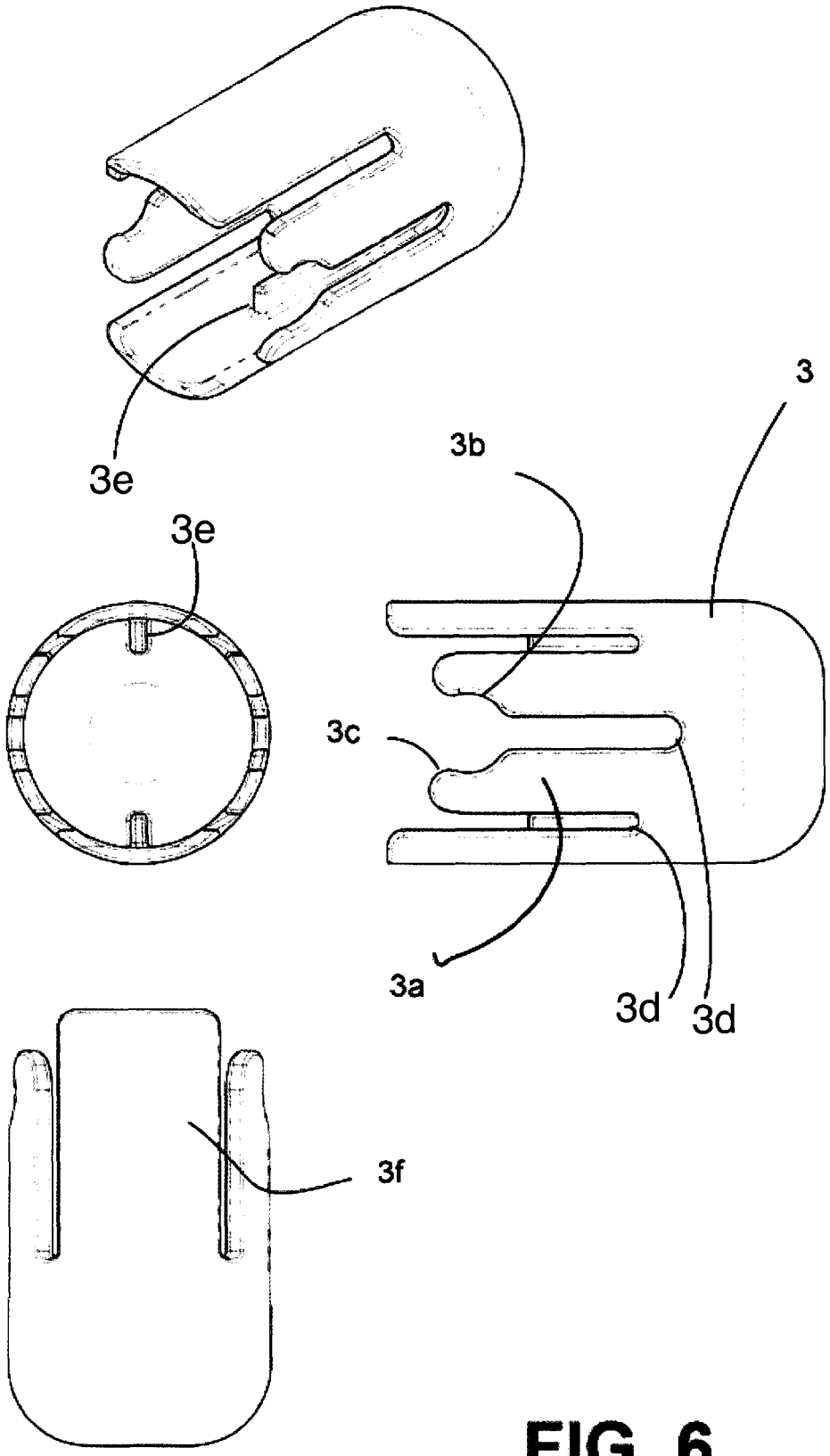
FIG. 6 consists of FIGS. 6A-D which are illustrative diagrams showing the protective snap on cap of the inventive device according to an exemplary embodiment of the present invention.

FIG. 4 is a depiction of the front cross sections in 3 positions at the pivot. It is noted that the upper cross sections at extremes are still circular and opening is constant.

FIG. 5A-5G is a diagram showing the various positions of oscillating tip according to a preferred construction of the tip and the body and both active ends to minimize the fatigue and wear. The cylindrical shaft is identified by reference numeral 12*a*. Base portion 12*b* is preferably made of heavier stem construction to support the cranking movement produced by the motor 10. Pivot pin clearance is identified by reference numeral 12*c*. Preferably, blade angle 12*d* is set at 47 degrees. Preferably, a slight radius 12*e* is provided for the scratching point to make for easier lift of hard to scratch latex material. Preferably, the edge of the scrapper is made thicker to avoid damage to substrates from which a film is to be removed. 12*g* identifies the cylindrical point of contact between the scrapper element and the crankshaft. 12*h* identifies the large clearance cavity for the crank shaft tip movement to lift semi solid lubricant provided for lubrication. Preferably, the tip area of the scraping element 12*i* is made relatively large to provide for longer life expectancy of use.

The protective snap on cap for the scrapper head 3 is depicted in FIG. 6A-6D. Reference numeral 3*a* identifies a flexible snap arm; 3*b* refers to the mating clamp; 3*c* to the under sized keeper; 3*d* to the flex arm cuts; and 3*e* to the nose stop limiter.

Figure 7:
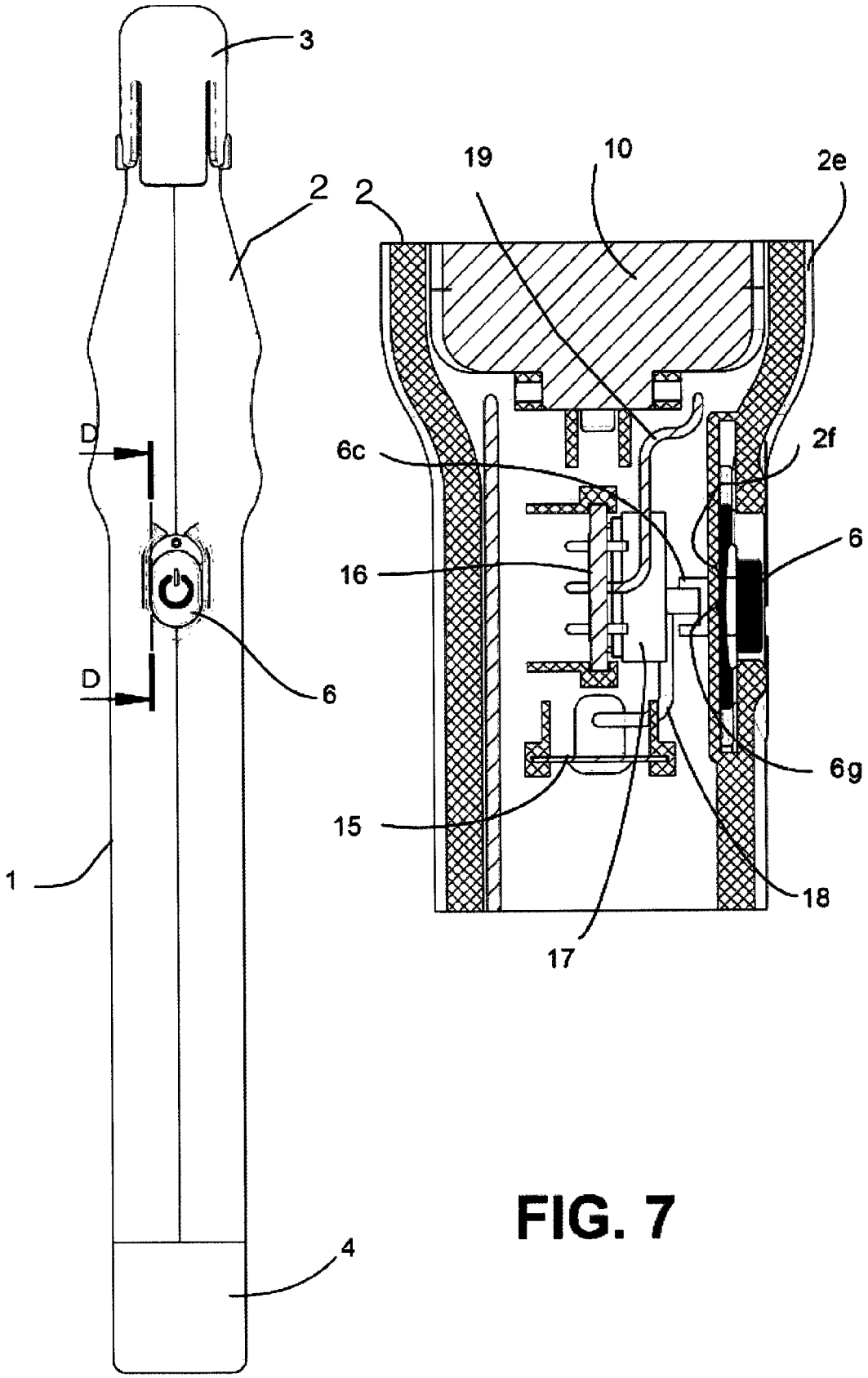
FIG. 7 consists of FIGS. 7A and 7B which are illustrative diagrams showing the slide switch mechanism with tactile feedback incorporated to the slide cap of the inventive device according to FIG. 7A.
Figure 8:
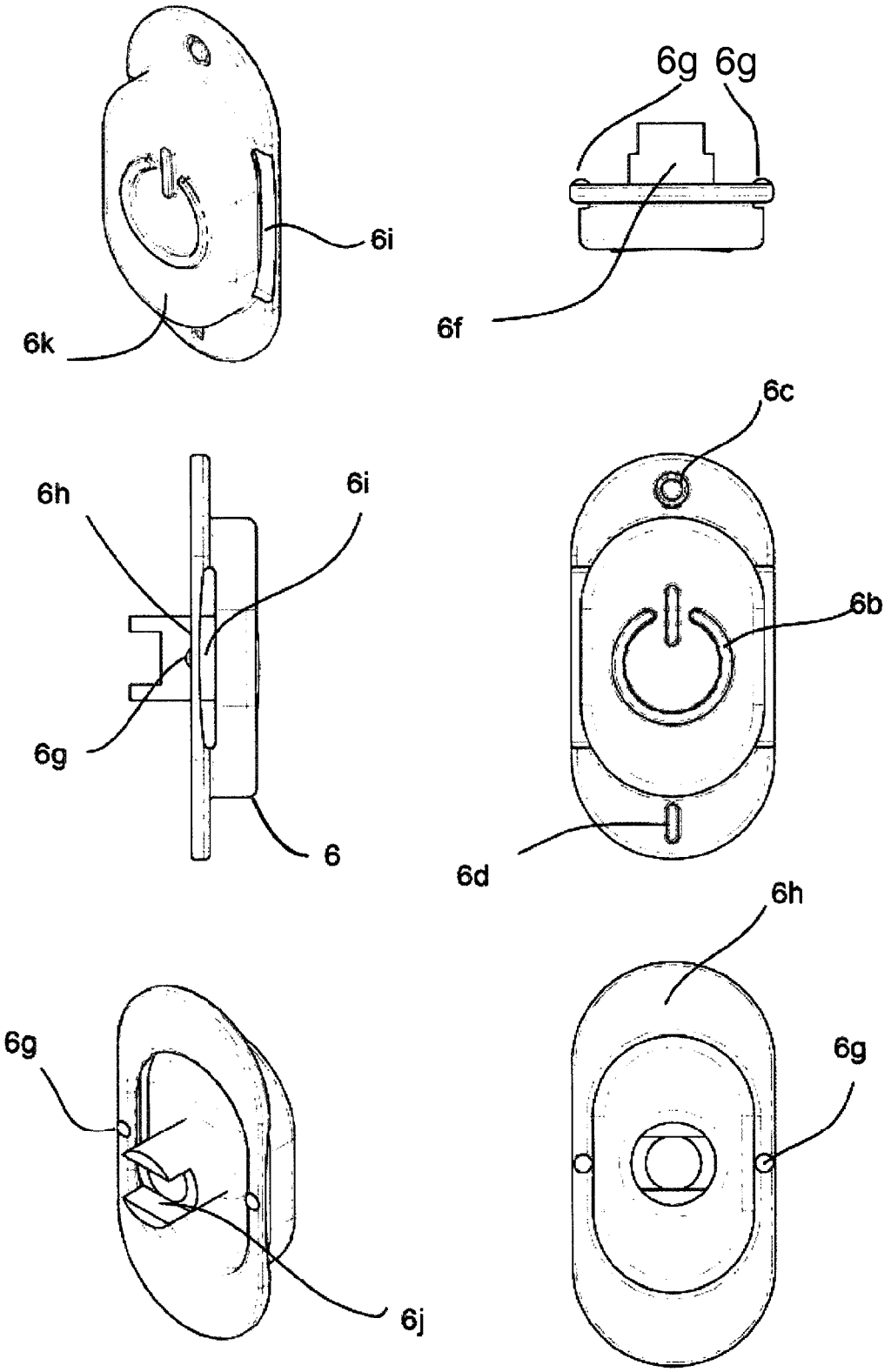
FIG. 8 consists of FIGS. 8A-8F which are illustrative diagrams showing the switch cap of the inventive device according to an exemplary embodiment of the present invention.
Figure 9:
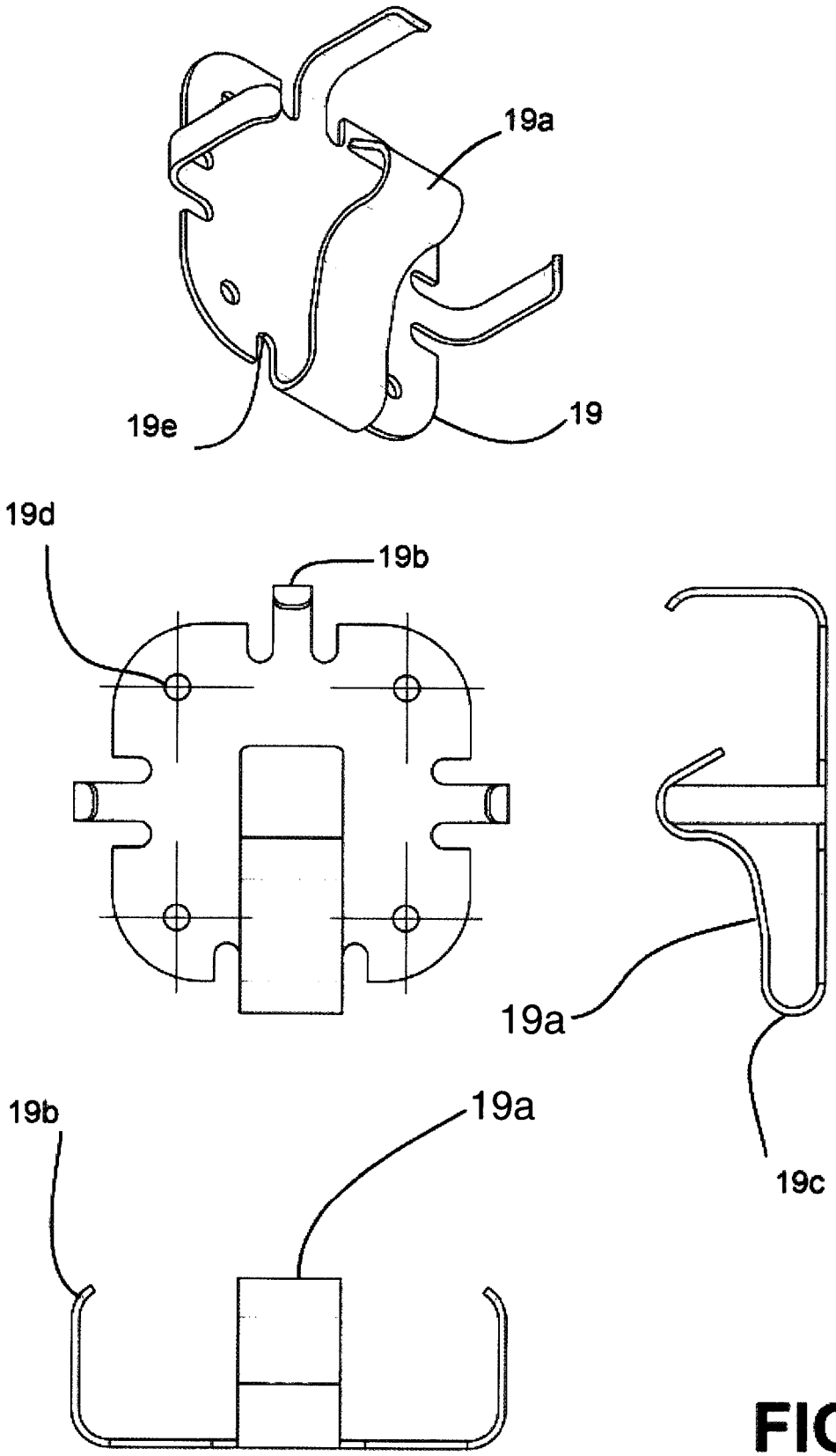
FIG. 9 consists of FIGS. 9A-9D which are illustrative diagrams showing the various views of a tail spring clip of the inventive device according to an exemplary embodiment of the present invention.
Figure 10:
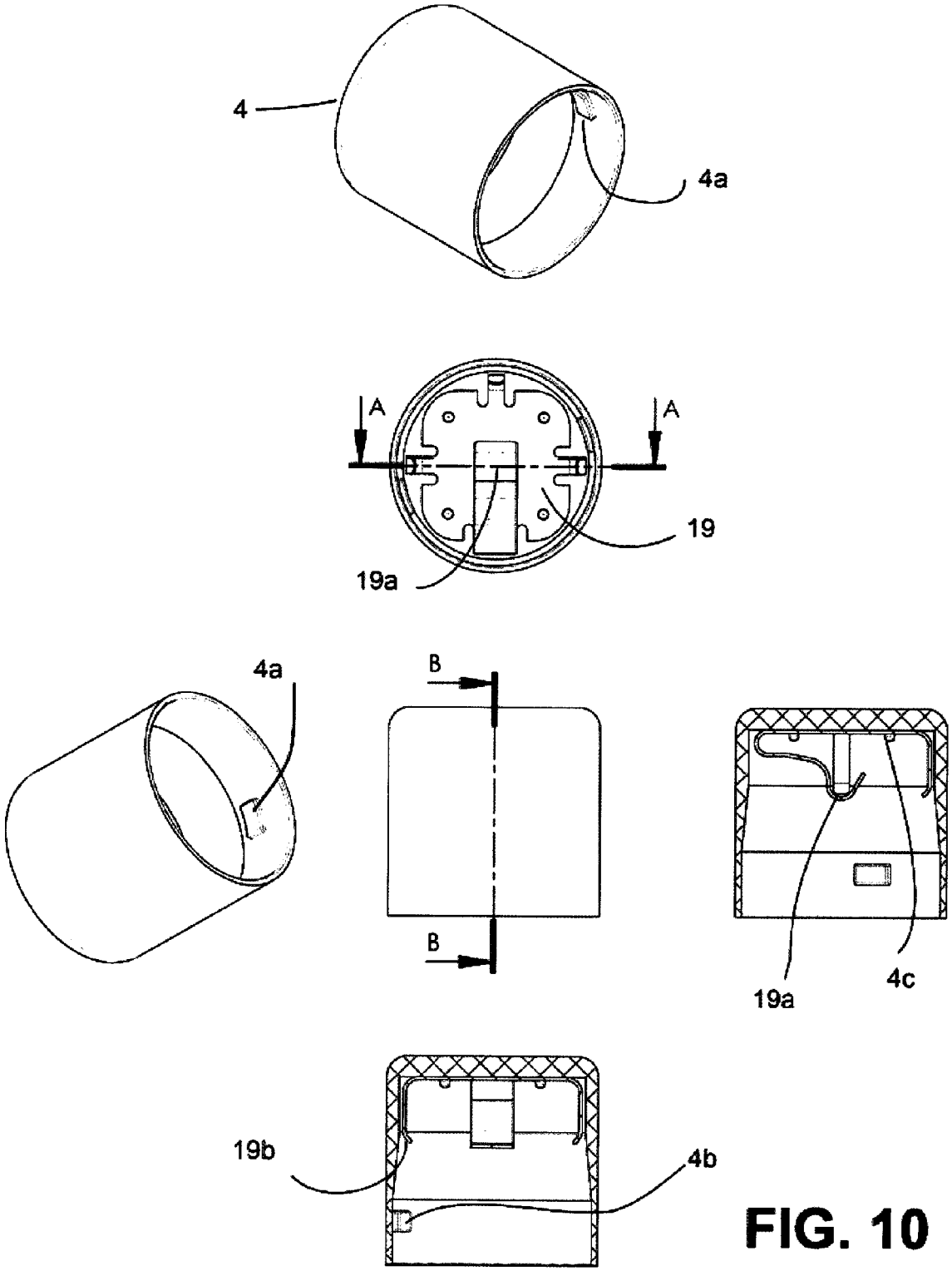
FIG. 10 consists of FIGS. 10A-10F which are illustrative diagrams showing the various views of the tail cap of the inventive device according to an exemplary embodiment of the present invention.
Figure 11:
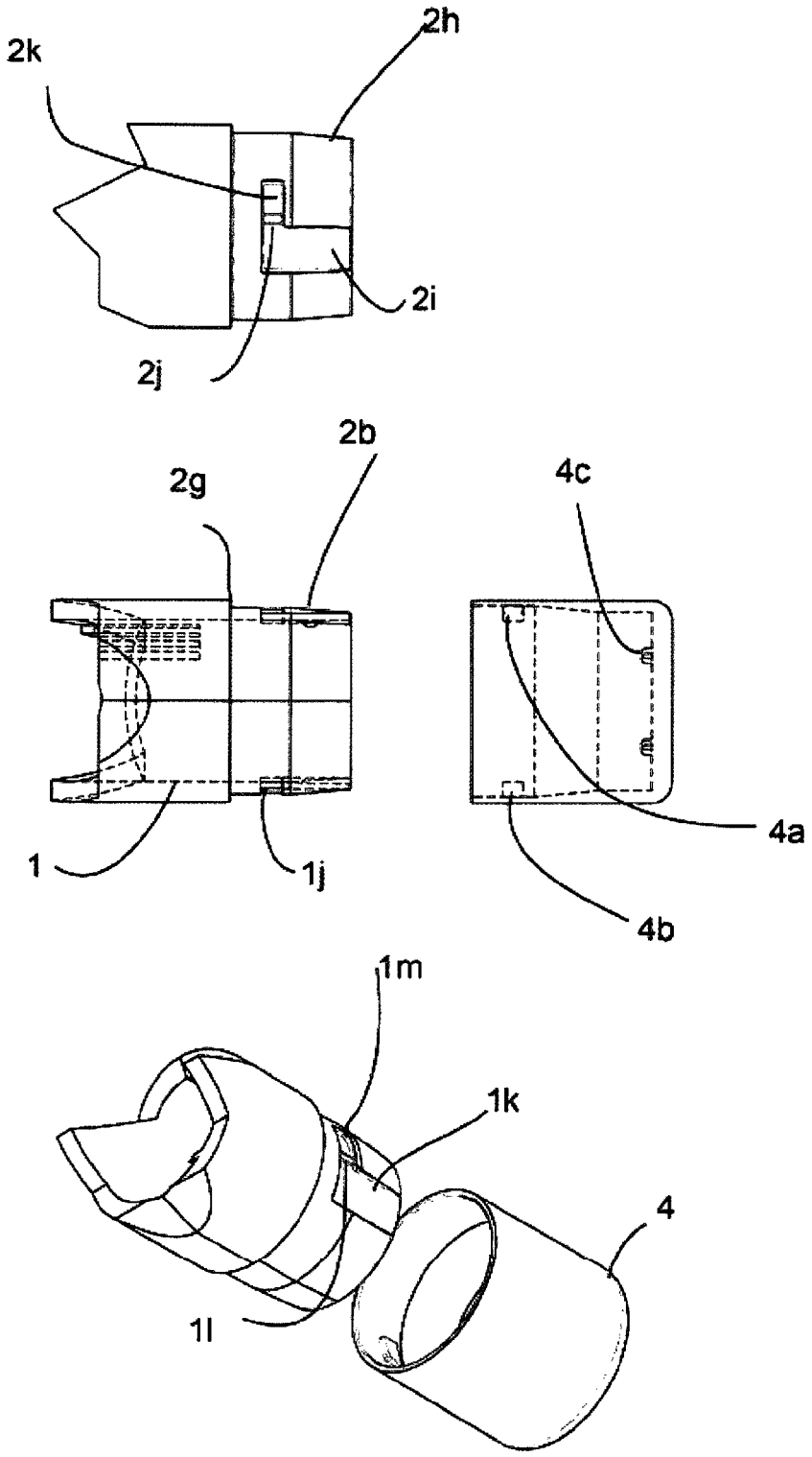
FIG. 11 consists of FIGS. 11A-11D which are illustrative diagrams showing the tail cap 30 degree turn fastening with main body of the inventive device according to an exemplary embodiment of the present invention.

FIG. 7A-7B shows the slide switch mechanism with tactile feedback incorporated to the slide cap body. In one embodiment, relive cuts on the housing platform at on and off locations will maintain the switch position. Item numbers are previously described. More detail on switch cap is provided with reference to FIG. 8A-8F.

FIG. 8A-8F shows various components of the switch cap 6. Reference numeral 6*b* refers to the on off logo; 6*d* and 6*c* respectively depict the on and off positions; 6*f* to the stem, 6*g* to snap bumps for tactile feedback; 6*h* to the flex arm; 6*i* to the flex space; 6*j* to the slide switch catch and 6*k* to the spherical dome.

FIG. 9A-9D shows the various elements of the tail cap spring clip 19. Reference numeral 19*a* refers to the battery negative center contact spring; 19*b* to the side to contact housing contact ring; 19*c* to the load loop; 19*d* to the eat stake mounting hole for tail cap; and 19*e* to the spring bend relief.

FIG. 10A-10F depicts the tail cap/negative battery spring ASM 4. The latch tab 30 degree turn two opposite places; reference numeral 4*c* refers to heat stake mounting. Other items shown have been described earlier.

FIG. 11A-11D depicts the tail cap at 30 degree turn fastening with main body. Left and right tracks are identified by reference numerals 2*h*, 2*i*. 2*j*, 2*k* on one half and lk, 11 on opposite sides will engage and lock with tail cap tabs 4*a* and 4*b*.

Figure 12:
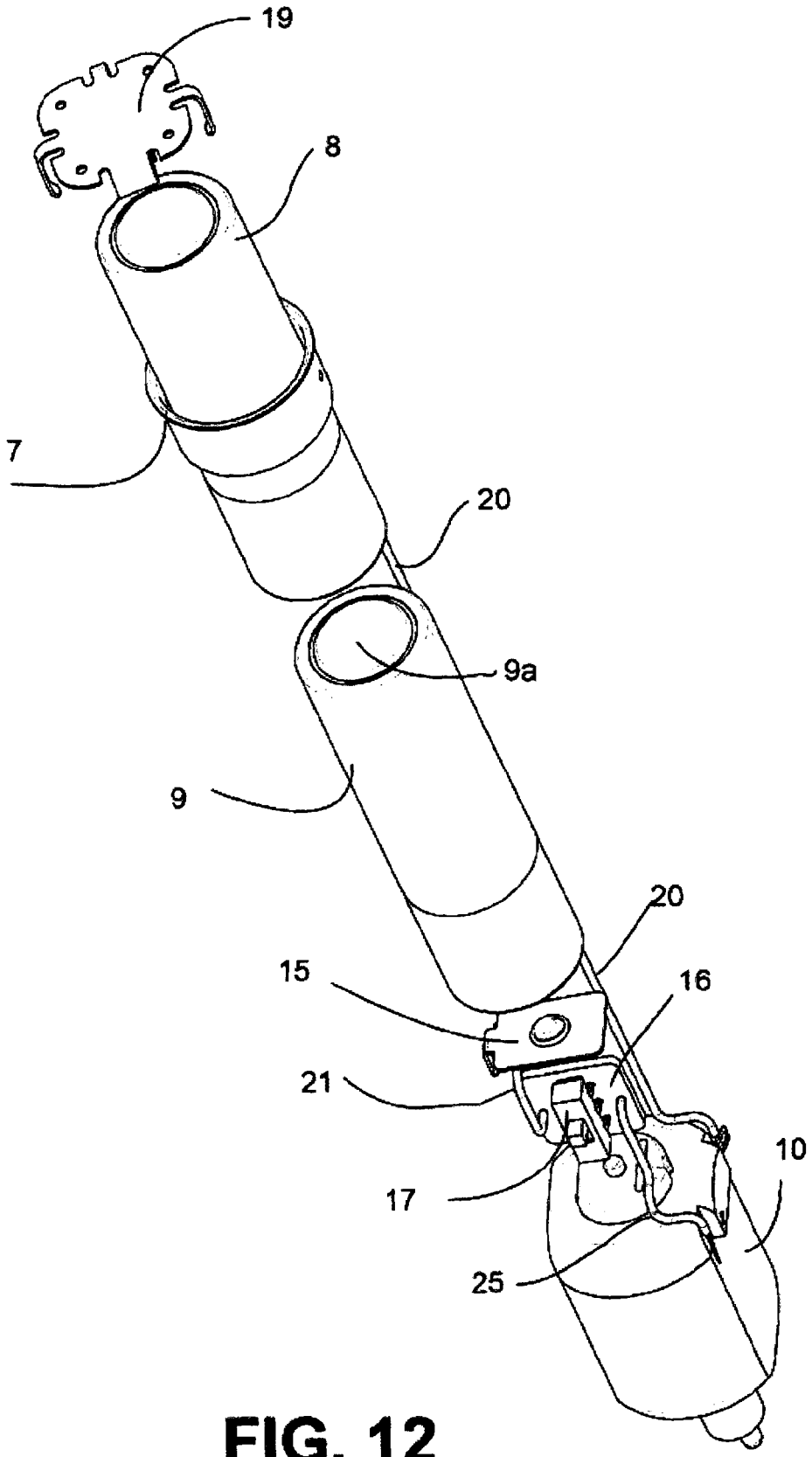
FIG. 12 is an illustrative diagram showing the electrical combination of the batteries contacts wiring, slide switch and the DC motor of the inventive device according to an exemplary embodiment of the present invention.

FIG. 12 is an illustration of the electrical combination of the batteries contacts wiring, slide switch and the DC motor.

Figure 13:
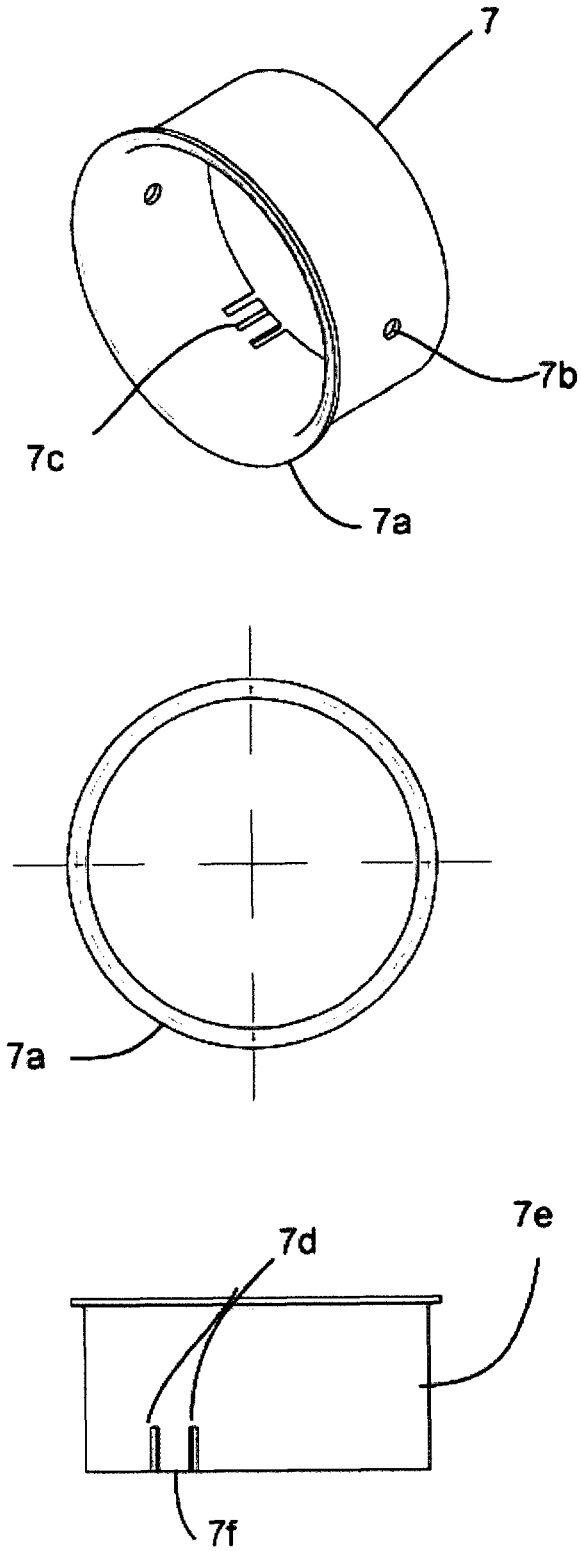
FIG. 13 consists of FIGS. 13A-13C which are illustrative diagrams showing the flanged tubular contact views of the inventive device according to an exemplary embodiment of the present invention.

FIG. 13A-13C depicts the tail cap negative contact ring 7 in flanged tubular contact views. Reference numeral 7*a* shows the flange to engage with tail cap spring clip; 7*b* the heat stake hole (2 places) to be positioned prior body halves snapping together; 7*c* the solder tab for negative wire connection to PC BD and 7*d* and 7*f* to provide quick temp rise for soldering.

What is claimed is:

1. A device for removing a covering film layer off of a ticket, said device comprising:

a cylindrical housing comprising:

a battery compartment having at least one battery;

a motor powered by the at least one battery within the battery compartment;

a crankshaft connected to the motor:

a scrapper element in contact with the crankshaft which moves in response to the motion generated by the motor;

wherein the scrapper element includes a tip that, when in contact with the film later on the ticket, removes the film from the ticket; and wherein the scrapper element moves from side to side along an axis perpendicular to a longitudinal axis in a non-rotational motion.

2. The device of claim 1, wherein the tip is a blade cut at a 47 degree angle with the scrapper element.

3. The device of claim 2, further comprising. a protective cap for the blade.

4. A device for removing a covering film layer off of a ticket, said device comprising:

a cylindrical housing comprising:

a battery compartment having at least one battery;

a motor powered by the at least one battery within the battery compartment;

a crankshaft connected to the motor;

a scrapper element in contact with the crankshaft which moves along an axis perpendicular to a longitudinal axis in a non-rotational motion in response to the motion generated by the motor;

wherein the scrapper element includes a tip that, when in contact with the film later on the ticket, removes the film from the ticket; and a protective snap on cap for covering the scraper element and tip.

5. The device of claim 4, wherein the tip is a blade cut at a 47 degree angle with the scrapper element.

6. The device of claim 4, wherein the cap further comprises:

a flexible snap arm;

a mating claim;

a under sized keeper;
a flex arm cut; and
a nose stop limiter.

* * * * *